US005957754A

United States Patent [19]

Brown et al.

[11] Patent Number: 5,957,754

[45] Date of Patent: Sep. 28, 1999

[54] CAVITATIONAL POLISHING PAD CONDITIONER

[75] Inventors: Kyle A. Brown, Sunnyvale; Boris Fishkin, San Carlos, both of Calif.

[73] Assignee: Applied Materials, Inc., Santa Clara, Calif.

[21] Appl. No.: 08/927,113

[22] Filed: Aug. 29, 1997

[51] Int. Cl.[6] ..... B24B 1/00

[52] U.S. Cl. ..... 451/41; 451/36; 451/56; 451/285

[58] Field of Search ..... 451/36, 41, 56, 451/285

[56] References Cited

U.S. PATENT DOCUMENTS

| | | | |
|---|---|---|---|
| 5,070,570 | 12/1991 | Sabo . | |
| 5,081,051 | 1/1992 | Mattingly et al. . | |
| 5,154,021 | 10/1992 | Bombardier et al. . | |
| 5,167,667 | 12/1992 | Prigge et al. . | |
| 5,216,843 | 6/1993 | Breivogel et al. . | |
| 5,245,790 | 9/1993 | Jerbic . | |
| 5,245,796 | 9/1993 | Miller et al. | 451/443 |
| 5,456,627 | 10/1995 | Jackson et al. . | |
| 5,486,131 | 1/1996 | Cesna et al. . | |
| 5,522,965 | 6/1996 | Chrisholm et al. . | |
| 5,650,039 | 7/1997 | Talieh . | |
| 5,716,264 | 2/1998 | Kimura et al. | 451/443 |

FOREIGN PATENT DOCUMENTS

| | | |
|---|---|---|
| 0 779 647 A1 | 6/1997 | European Pat. Off. . |
| 09029619 | 4/1997 | Japan . |
| WO 98/06540 | 2/1998 | WIPO . |

*Primary Examiner*—David A. Scherbel
*Assistant Examiner*—Shantese McDonald
*Attorney, Agent, or Firm*—Fish & Richardson

[57] ABSTRACT

A chemical mechanical polishing system comprising a moving polishing pad and an ultrasonic conditioning head. The head is positioned in close facing relationship to the pad surface and agitates a liquid on the rotating pad surface at an appropriate frequency and sufficient amplitude to produce cavitation of the slurry in the vicinity of the pad surface. The action of cavitational collapse vigorously conditions the pad, driving out contaminants and re-texturizing the pad.

12 Claims, 3 Drawing Sheets

CAVITATIONAL POLISHING PAD CONDITIONER

BACKGROUND OF THE INVENTION

This invention relates generally to the polishing and planarization of semiconductor substrates and, more particularly, to the conditioning of polishing pads in slurry-type polishers.

Integrated circuits are typically formed on substrates, particularly silicon wafers, by the sequential deposition of conductive, semiconductive or insulative layers. After each layer is deposited, the layer is etched to create circuitry features. As a series of layers are sequentially deposited and etched, the outer or uppermost surface of the substrate, i.e., the exposed surface of the substrate, becomes successively less planar. This occurs because the distance between the outer surface and the underlying substrate is greatest in regions of the substrate where the least etching has occurred, and least in regions where the greatest etching has occurred. With a single patterned underlying layer, this non-planar surface comprises a series of peaks and valleys wherein the distance between the highest peak and the lowest valley may be the order of 7000 to 10,000 Angstroms. With multiple patterned underlying layers, the height difference between the peaks and valleys becomes even more severe, and can reach several microns.

This non-planar outer surface presents a problem for the integrated circuit manufacturer. If the outer surface is non-planar, then photolithographic techniques to pattern photoresist layers might not be suitable, as a non-planar surface can prevent proper focusing of the photolithography apparatus. Therefore, there is a need to periodically planarize the substrate surface to provide a planar surface. Planarization, in effect, polishes away a non-planar, outer surface, whether a conductive, semiconductive, or insulative layer, to form a relatively flat, smooth surface. Typically, an insulative layer is deposited across the entire surface to be planarized filling valleys but also covering peaks in the surface. Planarization thus removes this layer from above the peaks leaving a substantially uniform planar surface. Following planarization, additional layers may be deposited on the outer layer to form interconnect lines between features, or the outer layer may be etched to form vias to lower features.

Chemical mechanical polishing is one accepted method of planarization. This planarization method typically requires that the substrate be mounted on a carrier or polishing head, with the surface of the substrate to be polished exposed. The substrate is then placed against a rotating polishing pad. The carrier head may also rotate and/or oscillate to provide additional motion between the substrate and polishing surface. Further, a polishing slurry, including an abrasive and at least one chemically-reactive agent, may be spread on the polishing pad to provide an abrasive chemical solution at the interface between the pad and substrate.

Important factors in the chemical mechanical polishing process are: the planarity of the substrate surface, uniformity, and the polishing rate. Inadequate planarity can produce substrate defects. The polishing rate sets the time needed to polish a layer. Thus, it sets the maximum throughput of the polishing apparatus.

Each polishing pad provides a surface which, in combination with the specific slurry mixture, can provide specific polishing characteristics. Thus, for any material being polished, the pad and slurry combination is theoretically capable of providing a specified planarity on the polished surface. The pad and slurry combination can provide planarity in a specified polishing time. Additional factors, such as the relative speed between the substrate and the pad, and the force pressing the substrate against the pad, affect the polishing rate and planarity.

Because inadequate planarity can create defective substrates, the selection of a polishing pad and slurry combination is usually dictated by the required planarity. Given these constraints, the polishing time needed to achieve the required planarity sets the maximum throughput of the polishing apparatus.

It is important to take appropriate steps to counteract any deteriorative factors which either present the possibility of damaging the substrate (such as by scratches resulting from accumulated debris in the pad) or reduce polishing speed and efficiency (such as results from glazing of the pad surface after extensive use). The problems associated with scratching the substrate surface are self-evident. The more general pad deterioration both decreases polishing efficiency, which therefore increases cost, and creates difficulties in maintaining consistent operation from substrate to substrate as the pad decays.

The glazing phenomenon is a complex combination of contamination and thermal, chemical and mechanical damage to the pad material. When the polisher is in operation, the pad is subject to compression, shear and friction producing heat and wear. Slurry, including the abraded material from the wafer and pad, is pressed into the pores of the pad material and the material itself becomes matted and even partially fused, all of which reduce the pad's ability to apply fresh slurry to the substrate.

It is, therefore, desirable to continually condition the pad by removing trapped slurry, and unmatting or re-expanding the pad material.

A number of conditioning procedures and apparatus have been developed. Common are mechanical methods wherein an abrasive material is placed in contact with the moving polishing pad. For example, a diamond coated screen or bar which scrapes and abrades the pad surface to a moderate extent both removes the contaminated slurry trapped in the pad pores and expands and re-roughens the pad. With such systems, abrasive particles from the conditioner may themselves become dislodged from their source and will become contaminates for the pad and the slurry. Further, the mechanical grinding away of the pad reduces pad life. The mechanical abrasive elements themselves are also quite expensive, typically comprising embedded diamond particles, and their use imposes the further downtime required to break-in the abrasive. Typically, a new abrasive element must be broken-in by running it on a pad for approximately thirty minutes to remove any loose abrasive particles prior to the polishing of any wafers so as to avoid scratching the wafers.

An alternative method which largely avoids the dangers of contamination is the ultrasonic agitation of the slurry as disclosed in U.S. Pat. No. 5,245,796 of Gabriel L. Miller and Eric R. Wagner, issued Sep. 21, 1993 (hereinafter Miller, et al.). Miller, et al. discloses the use of an ultrasonic generator placed one-half inch above the pad surface and oscillated at a frequency of 40 KHz to dislodge grit and debris which become embedded in the pad. Miller, et al., however, fails to address the mechanical deterioration of the pad that occurs with glazing.

It is, accordingly, desirable that a conditioner remove debris from the pad and undo glazing while avoiding the introduction of additional mechanical abrasive to the slurry, thus restoring the mechanical structure of the pad without doing unwanted amounts or types of mechanical damage to the pad.

SUMMARY OF THE INVENTION

In one embodiment, the invention provides a chemical mechanical polishing system comprising: a moving polishing pad with a polishing surface; a wafer carrier holding a wafer and placing a face of the wafer in sliding engagement with the polishing surface; and an ultrasonic conditioner. The conditioner has a narrow elongate agitating head positionable at least in partial contact with a liquid on the polishing surface and in close facing relationship to the polishing surface during rotation. An oscillator oscillates the head so as to agitate the liquid at an appropriate frequency and sufficient amplitude to produce cavitation of the liquid in the vicinity of the pad surface. The action of cavitational collapse vigorously conditions the pad, driving out contaminants and re-texturizing the pad so as to maintain its polishing effectiveness.

In certain implementations, the head may have a length that is at least as large as a diameter of the wafer and may have a width less than 0.5 inches. An exemplary spacing between the head and pad may be less than 0.1 inches, or more particularly, even smaller such as between 0.010 inches 0.030 inches. The head may have a concavity along its length so that spacing between the polishing surface and a lower face of the head is relatively greater at intermediate radii of the polishing pad then at central or peripheral radii of the polishing pad. The liquid may comprise a polishing slurry applied to the pad for polishing the substrate or may comprise a separate conditioning liquid, such as deionized water, which may be held in a stationary pool area atop the moving polishing pad, the remaining area atop the polishing pad being covered with polishing slurry.

Among the advantages of the invention are the following. The cavitational conditioning feature reduces damage to wafers caused by abrasives (such as diamond dust) which may be dislodged from a mechanical abrasive conditioner. Furthermore, whereas mechanical abrasive conditioners substantially operate by grinding away the exposed uppermost layer of the polishing pad, the cavitational conditioner can leave a greater amount of the pad intact, thus increasing pad life. A significant benefit of an increase in pad life is less total downtime resulting from the less frequent replacement of pads. This results in higher overall throughput. Downtime is further reduced as the eliminated or reduced use of abrasive elements eliminates or reduces the down time spent replacing and breaking in new elements. Costs of consumables, such as the pad, retaining rings and other components which may be worn by the use of abrasives, are also reduced.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

The accompanying drawings which are incorporated in and constitute a part of the specification schematically illustrate the invention, and together with the general description given above and the detailed description given below, serve to explain the principles of the invention.

Like reference numbers and designations in the various drawings indicate like elements.

DETAILED DESCRIPTION

Figure 1:
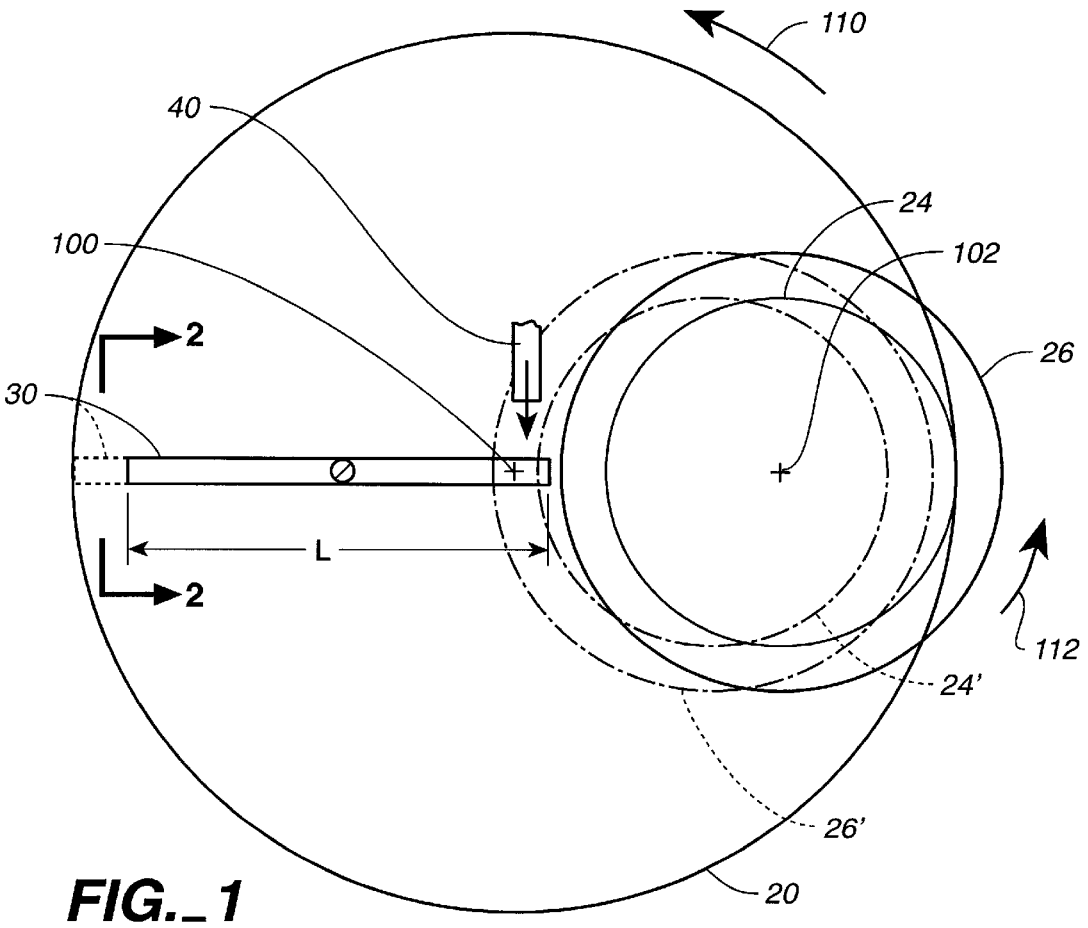
FIG. 1 is a partial semi-schematic top view of a single platen area of a chemical mechanical polishing (CMP) system having a conditioner according to principles of the invention.
Figure 2:
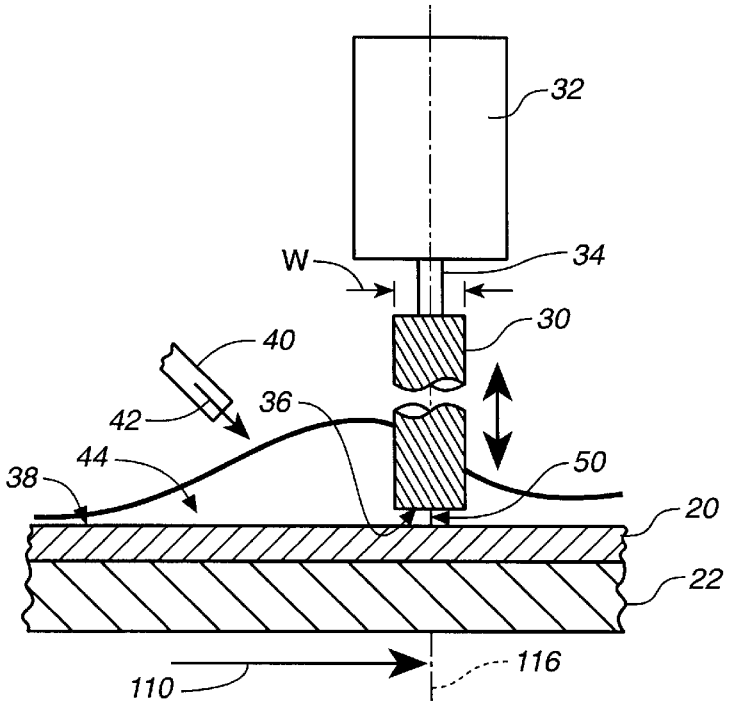
FIG. 2 is a partial, semi-schematic and cut-away, cross-sectional view of the conditioner of FIG. 1, taken along line 2—2.

As shown in FIG. 1, a polishing pad 20 is secured atop a platen 22 (FIG. 2) and rotates about a central axis 100 in a counter-clockwise direction 110. A circular semiconductor wafer 24 is held by a wafer carrier or polishing head 26 which firmly places a lower face of the wafer in sliding engagement with the upper (polishing) surface of the pad. The carrier and wafer rotate as a unit about their common central axis 102 in a counter-clockwise direction 112. In addition to the rotation, the carrier and wafer are simultaneously reciprocated between the solid line positions and the broken line positions 24' and 26' shown in FIG. 1. In an exemplary embodiment, the pad 20 has a diameter of 20.0 inches, the wafer 24 has a diameter of 7.87 inches (for a 200 millimeter wafer, commonly referred to as an "8 inch" wafer), the carrier 26 has a external diameter of 10.0 inches and the carrier reciprocates so that the separation of its central axis 102 from the central axis 100 of the pad ranges between 4.2 and 5.8 inches. The rotational speed of the pad may be in an exemplary range of 20–150 rpm and that of the carrier may be in a similar range. In certain embodiments, the speeds of the pad and carrier may be slightly different from each other (such as by 3–5 rpm) to avoid resonance effects. An agitator, having an elongate head 30, is positioned approximately diametrically opposite to the carrier 26. As shown in FIG. 2 the head 30 is connected to an oscillator 32 via a shaft 34 (removed in FIG. 1 for purposes of illustration). The agitator may comprise a piezoelectric-type ultrasonic transducer and may be supported by a gantry (not shown). The lower face 36 of the head is in close facing relationship with the polishing face 38 of the pad.

A nozzle 40 is located ahead of the agitator (the "ahead" direction corresponding to a direction counter to the rotation of the pad). The nozzle emits a stream 42 of polishing slurry which forms a slurry layer 44 atop the pad. The nozzle may take the form of a point source near the central axis of the pad, relying on a centrifuge effect to disperse the slurry along the length of the conditioner. The nozzle 40 may reciprocate along with the conditioner. A narrow elongate space 50 is defined in the slurry between the polishing surface of the pad and a bottom face 36 of the head. In the illustrated embodiment, the spacing between the polishing surface and bottom face of the head is approximately 0.02 inches, the width of the bottom face is approximately 0.25 inches and its length is approximately 9 inches. This length (L) is selected to be at least as large as the diameter of the wafer which is advantageous for providing a correspondingly broad swath of conditioning. The vigorous oscillation of the head 30, making a vertical reciprocation along agitator axis 116 is at sufficient amplitude and frequency that it is believed to induce cavitation of the fluid in space 50. When the induced cavities collapse, the action of cavitational collapse cleans the polishing surface of the pad of debris and re-texturizes the pad. Exemplary oscillation frequencies may typically range between 20 and 100 kHz; for instance, the frequency may be at substantially 40 kHz. An exemplary amplitude of oscillation at 20 kHz is approximately 75 $\mu$m. The minimized spacing between head and pad maximizes pressure fluctuations near the pad surface and thus helps efficiently induce cavitation at or near the pad surface. The spacing is less than 0.10 inches and may be between approximately 0.01 and 0.03 inches. Head width or thickness (W) is influenced by concerns for sufficient footprint (width×length of the portion of the bottom of the head in contact with the liquid) to provide the necessary degree of conditioning and not so large a footprint that would require too high a power or provide too much agitation. Preferred head thickness would thus be between approximately 0.1 and 0.5 inches. The oscillation in an exemplary embodiment is sufficient to induce cavitation with a cavity size of approximately 100 $\mu$m.

The carrier and conditioner reciprocate substantially in phase, the conditioner operating at the same time as the wafer is being polished. The reciprocation of the carrier 24 and the reciprocation of the conditioner head 30 may be purely linear or pseudo-linear, an example of the latter being reciprocation along an arc segment such as with a gantry that pivots on a remote axis. If desired, the conditioner may be made to operate intermittently or its operational zone may be varied. For example, the agitator can operate only while the carrier is transferring wafers (and may thus be out of the way, permitting a greater range of motion of the agitator, or simply permitting a greater level of agitation than would be tolerated while the wafer was being polished). Especially if coupled to an appropriate device for scanning the pad and determining wear and contamination, the agitator may be made to spend more time over certain areas of the pad than in others to provide a greater degree of conditioning in the former areas or even to remove high spots in those areas. Satisfactory conditioning results have been obtained using a test head with a 6.0 inch by 0.25 inch footprint oscillated at 20 kHz with a power of 180 watts.

Figure 3:
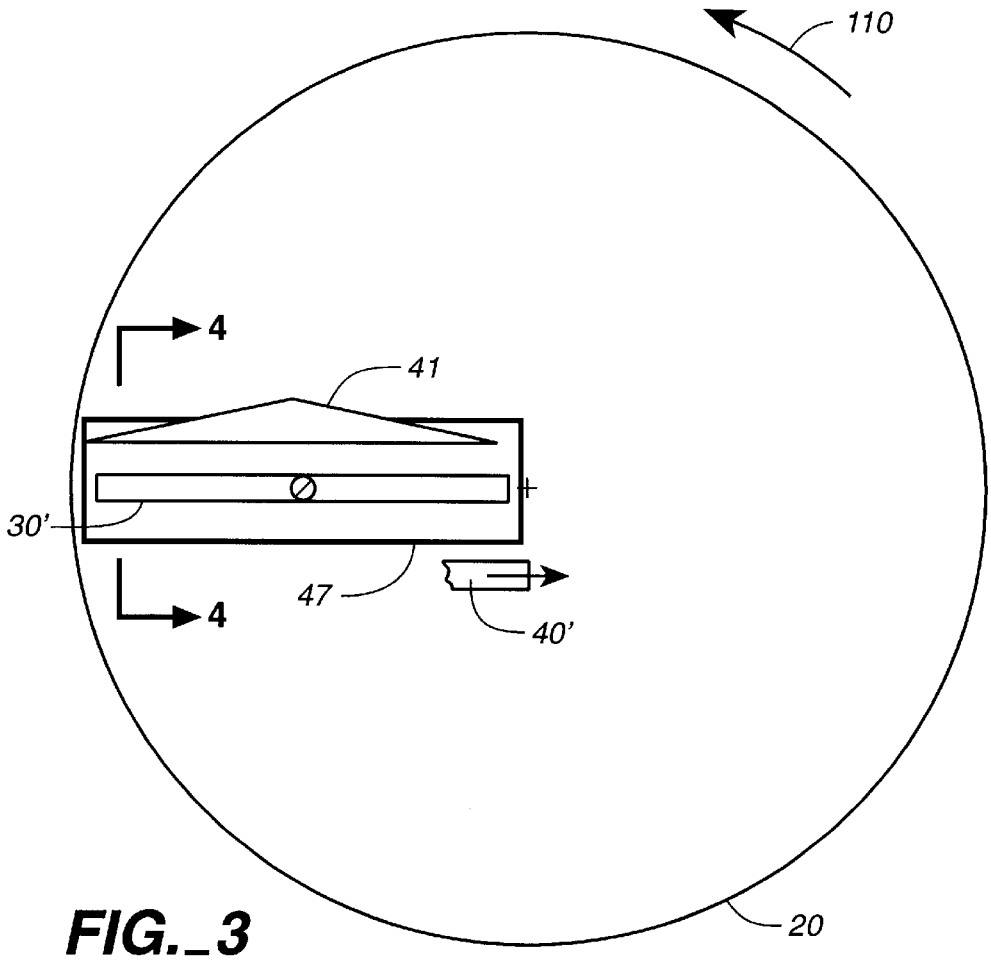
FIG. 3 is a partial semi-schematic top view of single platen area of a CMP system having an alternate conditioner according to principles of the invention.
Figure 4:
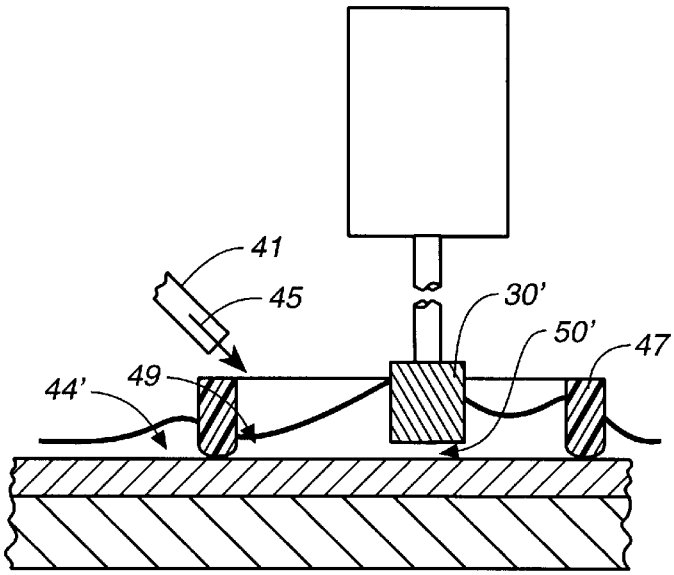
FIG. 4 is a partial, semi-schematic and cut-away, cross-sectional view of the conditioner of FIG. 4, taken along line 4—4.

An alternate conditioner is shown in FIG. 3 and 4. Certain structure such as the pad and wafer carrier may be otherwise the same as that of the embodiment of FIGS. 1 and 2. For purposes of illustration, the oscillator and wafer carrier are removed in FIG. 3. One aspect of this embodiment is the presence of a pool 47 surrounding and stationary relative to the agitator head 30. Nozzle 41 emits a stream 45 of conditioning fluid directly into the pool to form a body 49 of conditioning fluid (or such mixture of conditioning fluid and polishing slurry as results from leakage or from slurry trapped on the pad) within the pool 47 (the remaining area atop the pad being covered with polishing slurry). The conditioning fluid may differ from the polishing slurry, for example, comprising in part or substantial whole deionized water. Appropriate flow passages and/or a pump (not shown) may be provided for evacuating conditioning fluid from the pool or this may be accomplished through overflow, leakage or a combination of the two. A slurry nozzle 40', otherwise similar to nozzle 40, may be provided downstream of the pool for generating the slurry layer encountered by the wafer and carrier. The four walls of the rectangular pool may be held in light contact with the polishing surface of the pad either by an independent support or by the same gantry that holds the agitator. The force with which the pool is engaged to the polishing pad should be not so high that the pool walls are undesirably worn away but should be sufficient to hold any mixing of the conditioning fluid and slurry to an acceptable level. A process-compatible material (wear resistant and relatively chemically inert) such as polypenylene sulfide (PPS) is preferable for this barrier. For example, the pool may be made of the same material as is a retaining ring portion of the carrier.

Figure 5:
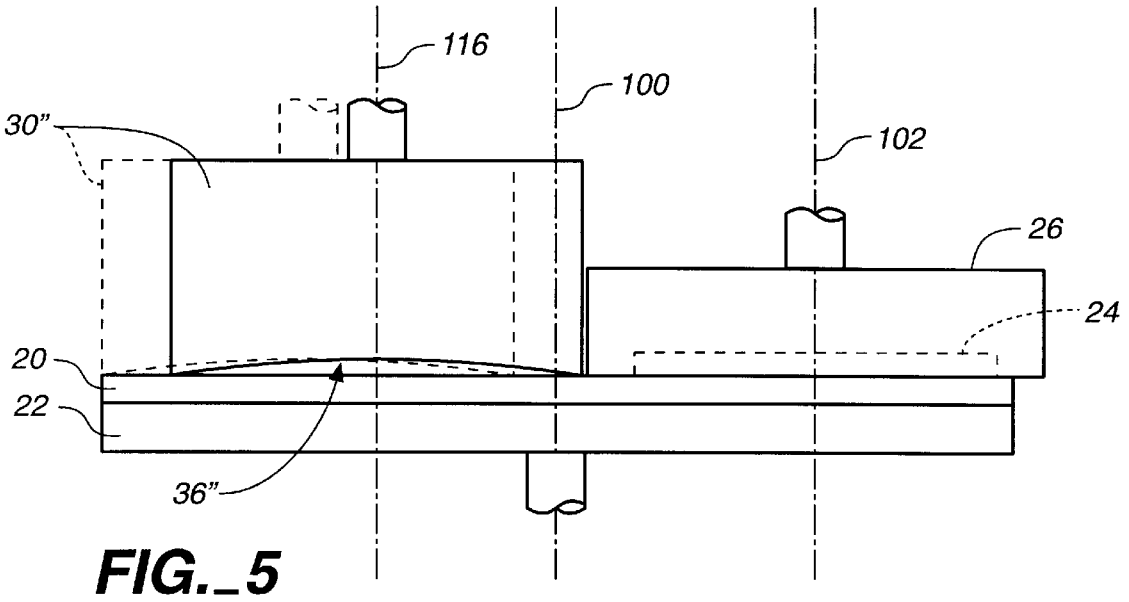
FIG. 5 is a partial semi-schematic side view of a single platen area of a CMP system having a second alternate conditioner according to principles of the invention.

Another alternate agitator head 30" is shown in FIG. 5. The lower face 36" of the head has slight concavity along its length so that the spacing between the pad and the lower face is relatively greater at intermediate radii of the pad than at the center or periphery. This concavity may be used to compensate for the tendency of the polishing of the wafer to wear down the pad in a region of intermediate radii and thus create an annular trough at such radii which degrades the uniformity of the polishing process, tending to produce a slightly convex crown on the wafer surface. Via increased cavitation adjacent the ends of the bottom face of the head, or by physical wear as the bottom face is brought into contact with the pad, the head produces compensatory wear at the center and the periphery of the pad to keep the pad flatter and thus reduce uniformity degradation.

A number of embodiments of the present invention have been described. Nevertheless, it will be understood that various modifications may be made without departing from the spirit and scope of the invention. For example, conditioner positioning may be altered or multiple small conditioners may be provided to facilitate more individualized addressing of glazing and wear at different radial locations of the pad. Additionally, the cavitational conditioner may be used in combination with a more conventional mechanical abrasive conditioner, with the abrasive conditioner primarily keeping the pad flat and the cavitational conditioner primarily keeping the pad clean. Also, the cavitational conditioner may be used with polishers other than the circular pad type, such as belt-type polishers. Accordingly, other embodiments are within the scope of the following claims.

What is claimed is:

1. An apparatus for polishing a semiconductor wafer, comprising:

a moving polishing pad having a polishing surface;

a wafer carrier for holding the wafer and placing a face of the wafer in sliding engagement with the polishing surface;

an agitator having a narrow elongate agitating head and positionable at least partially in contact with a liquid on the polishing surface and in close facing relationship to the polishing surface during rotation; and an oscillator for oscillating the head so as to agitate the liquid and induce cavitation of the liquid between the agitator head and the polishing surface.

2. The apparatus of claim 1 wherein the head has a length which is at least as large as a diameter of the wafer.

3. The apparatus of claim 2 wherein the carrier reciprocates in at least one substantially linear direction parallel to the pad surface.

4. The apparatus of claim 1 wherein the part of the agitator head in contact with the liquid has a width of less than 0.5 inches.

5. The apparatus of claim 1 wherein the spacing between the agitator head and the pad, at least under substantial portion of the part of the head in contact with the liquid, is no greater than 0.10 inches.

6. The apparatus of claim 5 wherein said spacing is between 0.010 inches and 0.030 inches.

7. The apparatus of claim 1 wherein the oscillator oscillates at a frequency of between 20 and 100 kHz.

8. The apparatus of claim 1 wherein the liquid is introduced to the pad upstream of the head and downstream of the carrier.

9. A method of polishing a semiconductor wafer, comprising:

placing a face of the wafer in contact with a polishing face of a polishing pad, the polishing face being covered with a polishing slurry and moving relative to the wafer; and agitating the slurry so as to induce cavitation in the slurry adjacent the polishing pad such that collapsing cavitation acts to maintain the polishing effectiveness of the pad.

10. An apparatus for polishing a substrate, comprising:

a rotatable polishing pad having a polishing surface;

a wafer carrier for holding the wafer and placing a face of the wafer in sliding engagement with the polishing surface; and an agitator having an agitating head positionable in close facing relationship to the polishing surface during rotation thereof such that action of the agitator induces cavitation of a liquid on the polishing surface between the agitating head and the polishing surface.

11. An apparatus for polishing a semiconductor wafer, comprising:

a rotatable polishing pad having a polishing surface;

a wafer carrier for holding the wafer and placing a face of the wafer in sliding engagement with the polishing surface;

an agitator having a narrow elongate agitating head positionable at least partially in contact with a conditioning liquid held in a stationary pool on the polishing surface, the head in close facing relationship to the polishing surface during rotation; and an oscillator for oscillating the head so as to agitate the liquid and induce cavitation of the liquid between the agitator head and the polishing surface.

12. An apparatus for polishing a semiconductor wafer, comprising:

a rotatable polishing pad having a polishing surface;

a wafer carrier for holding the wafer and placing a face of the wafer in sliding engagement with the polishing surface;

an agitator having a narrow elongate agitating head positionable at least partially in contact with a conditioning liquid on the polishing surface and in close facing relationship to the polishing surface during rotation, the agitating head having a concavity along its length so that spacing between the polishing surface and a lower face of the head is relatively greater at intermediate radii of the polishing pad than at central or peripheral radii of the polishing pad; and an oscillator for oscillating the head so as to agitate the liquid.

* * * * *